US007713408B2

(12) United States Patent
Breivik et al.

(10) Patent No.: US 7,713,408 B2
(45) Date of Patent: May 11, 2010

(54) PROCESS FOR THE CATALYTIC HYDROTREATING OF SILICON CONTAINING HYDROCARBON FEED STOCK

(75) Inventors: Rasmus Breivik, Hillerød (DK); Kim Grøn Knudsen, Hellerup (DK)

(73) Assignee: Haldor Topsoe A/S, Lyngby (DK)

( * ) Notice: Subject to any disclaimer, the term of this patent is extended or adjusted under 35 U.S.C. 154(b) by 371 days.

(21) Appl. No.: 11/976,297

(22) Filed: Oct. 23, 2007

(65) Prior Publication Data

US 2008/0116114 A1 May 22, 2008

(30) Foreign Application Priority Data

Nov. 22, 2006 (DK) ..... 2006 01523

(51) Int. Cl.
*C10G 45/04* (2006.01)

(52) U.S. Cl. ..... 208/213; 208/210; 208/216 R; 208/217

(58) Field of Classification Search ..... 208/210, 208/213, 216 R, 217
See application file for complete search history.

(56) References Cited

U.S. PATENT DOCUMENTS 5,118,406 A * 6/1992 Kokayeff et al. ..... 208/88
5,264,188 A * 11/1993 Lew ..... 422/208

FOREIGN PATENT DOCUMENTS

EP 1120454 * 8/2001
EP 1 188 811 3/2002

* cited by examiner

*Primary Examiner*—Glenn A Caldarola
*Assistant Examiner*—Brian McCaig
(74) *Attorney, Agent, or Firm*—Dickstein Shapiro LLP

(57) ABSTRACT

Process for the catalytic hydrotreating of a hydrocarbon feed stock containing silicon compounds comprising the steps of contacting the feed stock in presence of hydrogen with a first hydrotreating catalyst being arranged in at least two reactors being connected in series at an outlet temperature of up to 410° C. to reduce content of the silicon compounds in the feed stock;

cooling of the feed stock such treated to a temperature of between 280° and 350° C.; and contacting the cooled feed stock with a second hydrotreating catalyst at conditions being effective in reduction of sulphur compound and nitrogen compound concentration.

2 Claims, 1 Drawing Sheet

PROCESS FOR THE CATALYTIC HYDROTREATING OF SILICON CONTAINING HYDROCARBON FEED STOCK

BACKGROUND OF THE INVENTION

The present invention relates to a process for the catalytic hydrotreating of silicon containing hydrocarbon feed stock.

A catalytic reformer and its associated hydrotreater are found in every modern refinery. With the advent of bimetallic reforming catalysts, sulphur and nitrogen are required to be very low in the reformer feed normally less than 0.5 ppm. Naphtha hydrofiner, processing straight-run feeds, meet these requirements while achieving cycle lengths of greater than 3 years even with low activity or regenerated catalysts.

Because of its low installation cost relative to other options, the delayed coker is often the system of choice for upgrading residual oils. However, delayed coker products cause additional processing difficulties in downstream units, particularly hydrotreaters and reforming catalysts are found to be sensitive to silicon deposits. For example, the residue from silicone oils used to prevent foaming in coker drums largely distils in the naphtha range and can cause catalyst deactivation in downstream naphtha hydrofiners and reforming units.

As further an example, naphtha is contaminated by silicon when silicone oil is injected in the well during petroleum extraction in deep water.

The origin of silicon deposits on naphtha hydrotreating catalysts can be traced back to the silicone oil added to the heavy residue feed of the delayed coker or to the silicone oil added to the silicone dwell (Kellberg, L., Zeuthen, P. and Jakobsen, H. J., Deactivation of HDT catalysts by formation of silica gels from silicone oil. Characterisation of spent catalysts from HDT of coker naphtha using $^{29}$Si and $^{13}$C CP/MAS NMR, J. Catalysis 143, 45-51 (1993)).

Because of gas formation, silicone oil (polydimethylsiloxane, PDMS) is usually added to the coker drums to suppress foaming. This silicone oil usually cracks or decomposes in the coker to form modified silica gels and fragments. These gels and fragments mainly distil in the naphtha range and are passed to a hydrotreater together with the coker naphtha. Other coker products will also contain some silicon, but usually at lower concentrations than in naphtha products.

Silica poisoning is a severe problem when hydroprocessing coker naphthas. The catalyst operation time will typically depend on the amount of silicon being introduced with the feedstock and on silicon "tolerance" of the applied catalyst system. In absence of silicon in the feed, most naphtha hydroprocessing catalyst cycle lengths exceed three years. Deposition of silicon in form of a silica gel with a partially methylated surface from coker naphthas deactivates the catalyst and reduces the typical HDS/HDN unit cycle lengths often to less than one year.

By selection of an appropriate catalyst, unit cycle lengths can be significantly extended over most typical naphtha hydrotreating catalysts.

Typical conditions for naphtha pre-treatment reactors are total pressures between 15 and 50 bars; average reactor temperature between 50° C. and 400° C. The exact conditions will depend on type of feedstock, the required degree of desulphurisation and the desired run length. The end of the run is normally reached when the naphtha leaving the reactor contains detective amounts of silicon.

For a refiner, the run length is a very important consideration. A shorter run length incurs high cost due to frequent catalyst replacement and extended downtime (time off-stream) for catalyst replacement resulting in loss of revenue because of less production of naphtha and feed to the reforming unit.

It is known from EP 1,188,811 to increase operation time of hydrotreating reactors for treatment of silicon containing feedstock, when moistening the hydrotreating catalyst is moisturised with an amount of water added to the feed stock.

Silicon uptake depends on type of catalyst and temperatures in the hydrotreater. An increase in temperature results in a higher uptake of the contaminants.

In a hydrotreating unit employing a single reactor, however, the inlet temperature is controlled by the sulphur removal reactions, which at a reactor outlet temperature of above 350° C. will result in recombination of sulphur compounds depending on the feed stock composition.

In the known hydrotreaters with a single reactor for the removal of silicon compounds and HDS/HDN, the process fluid leaving the silicon removal catalyst bed has to be cooled by quenching with cold hydrogen make-up gas and with cooled liquid product. Quenching with liquid product disadvantageously reduces the actual hydrogen partial-pressure, which must be compensated by raising the total operation pressure.

The general object of the invention is to improve efficiency and to increase operation time of hydrotreating reactors for treatment of silicon containing feedstock by improving run time length and silicon capacity of hydrotreating catalysts.

SUMMARY OF THE INVENTION

Accordingly, this invention is a process for the catalytic hydrotreating of a hydrocarbon feed stock containing silicon compounds comprising the steps of contacting the feed stock in presence of hydrogen with a first hydrotreating catalyst being arranged in at least two reactors being connected in series at an outlet temperature of up to 410° C. to reduce content of the silicon compounds in the feed stock;

cooling of the such treated feed stock to a temperature of between 250° and 350° C.; and contacting the cooled feed stock with a second hydrotreating catalyst at conditions being effective in reduction of sulphur compound and nitrogen compound concentration.

DETAILED DESCRIPTION OF THE INVENTION

The hydrotreating unit according to the invention consists of at least two reactors for the removal of silicon compounds and at least one downstream reactor for the hydrotreating of the effluent from the upstream silicon removal reactors. Each reactor has one or more catalyst beds. The function of the hydrotreating reactors is primarily to reduce product sulphur, nitrogen and silicon.

Silicon is highly dispersed on the catalyst surface and initially forms monolayer coverage on the surface. The amount of silicon uptake depends then the operation temperature of the catalyst. The higher operation temperature, the higher the silicon uptake at constant catalyst metals loading.

As mentioned hereinbefore, the process temperature is limited to the required operation temperature of the HDS reaction, which is lower than the typical temperature as required for a high silicon removal capacity.

Typical inlet temperatures of the feed stock into the first silicon removal reactor are between 250° and 360° C. Coker feed stock contains olefins, which will be saturated by contact with the catalyst in the silicon removal reactors. The olefin saturation is exothermic and depending on the content of olefins in feed stock the outlet temperature from the reactors will be considerable higher.

In a process with a single rector process design for the concurrent removal of silicon and HDS/HDN the process has to be carried out at temperature not higher than about 350° C. because of sulphur recombination reactions.

When performing the process in a multi-reactor system in accordance with the invention, the silicon removal process can advantageously be carried out at higher temperatures than suitable in the HDS/HDN step, which results in a high capacity of silicon uptake on surface of the catalyst used in the silicon removal reactors and consequently in a longer process run length.

As further an advantage of the inventive process, the second reactor in the silicon removal step has retained still sufficient silicon uptake capacity even when the catalyst in the first reactor is spent. This allows replacement of the spent catalyst in the first reactor without a downtime in the hydrotreating plant, when the feed stock is bypassed to the second reactor during catalyst replacement in the first reactor.

Catalysts employed in the hydrotreating reactors contain usually at least one metal on a porous refractory inorganic oxide support. Examples of metals having hydrotreating and silicon removal activity include metals from groups VI-B and VIII e.g. Co, Mo, Ni, W, Fe with mixtures of Co—Mo, Ni—Mo and Ni—W preferred. The metals are usually in the form of oxides or sulphides. Examples of porous material suitable as support include alumina, silica-alumina and alumina-titania, whereby alumina and silica-alumina are preferred.

The active metal on the catalyst may either be presulphided or in-situ sulphided prior to use by conventional means.

DETAILED DESCRIPTION OF THE INVENTION

Figure 1:
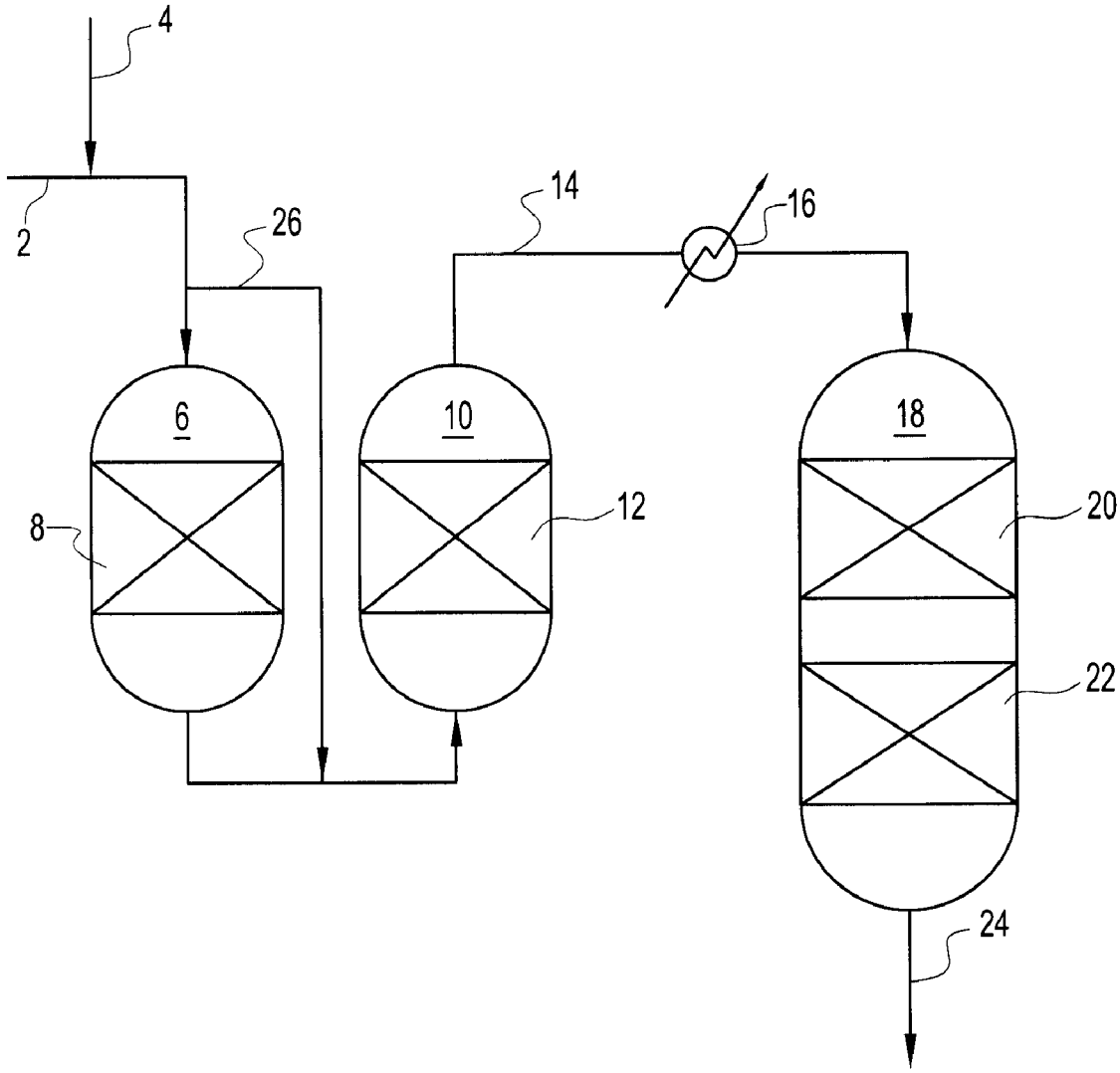
FIG. 1 of the drawings is a simplified flow sheet illustrating a specific embodiment of a process according to the invention.

Referring to FIG. 1, heated coker feed stock from a coker furnace (not shown) is introduced through line 2 at a temperature of 280° C. into a first silicon removal reactor 6. Hydrogen is introduced into the feed though line 4. Reactor 6 is provided with a fixed bed 8 of a commercially available hydrotreating catalyst containing Ni and Mo on alumina being capable of removing silicon compounds. The feed stock such treated is passed to a second reactor 10 being provided with a catalyst bed holding the same catalyst as employed in reactor 6. Silicon free effluent is withdrawn from reactor 10 in line 14. Due to olefin saturation reactions in reactors 6 and 8, the temperature of the effluent has increased to about 380° C. In order to avoid sulphur recombination during HDS and HDN in subsequent hydrotreating reactor 18, effluent 14 is cooled in cooler 16 to a temperature of about 310° C. Cooling of the effluent may be carried out by any cooling agent. Preferably, cooler 16 is a feed-effluent cooler using the feed stock from a coker drum (not shown) as cooling agent, before the feed is heated in the coker furnace.

Reactor 18 is provided with two beds 20 and 22 with a commercial Ni—Mo on alumina hydrotreating catalyst. A product effluent being substantially free of organo-sulphur and organo-nitrogen compounds is withdrawn from reactor 18 in line 24 at a temperature of about 330° C., which is below the critical temperature of sulphur recombination in the process stream.

As mentioned hereinbefore, a further advantage of the process according to the invention is the possibility to replace spent catalyst from reactor 6, which can be carried out without shutdown of the entire hydrotreating plant by passing feed stock 2 through line 26 to second reactor 10.

The invention claimed is:

1. Process for the catalytic hydrotreating of a hydrocarbon feed stock containing silicon compounds comprising the steps of contacting the feed stock in presence of hydrogen with a first hydrotreating catalyst being arranged in at least two reactors being connected in series at an outlet temperature of up to 410° C. to reduce content of the silicon compounds in the feed stock;

cooling of the feed stock such treated to a temperature of between 280° and 350° C.; and contacting the cooled feed stock with a second hydrotreating catalyst at conditions being effective in reduction of sulphur compound and nitrogen compound concentration.

2. Process of claim 1, wherein the feed stock is bypassed a first reactor with the first hydrotreating catalyst.

* * * * *